US006134822A

United States Patent [19]

Murgel

[11] Patent Number: 6,134,822

[45] Date of Patent: Oct. 24, 2000

[54] TRIGGER SAFETY BLOCK

[75] Inventor: Carlos A. P. Murgel, Porto Alegre, Brazil

[73] Assignee: Taurus International Manufacturing, Inc., Miami, Fla.

[21] Appl. No.: 09/157,523

[22] Filed: Sep. 21, 1998

[51] Int. Cl.[7] ..... F41A 17/54

[52] U.S. Cl. ..... 42/70.07; 42/70.11

[58] Field of Search ..... 42/70.06, 70.07, 42/70.11; 211/4, 64; 70/58

[56] References Cited

U.S. PATENT DOCUMENTS

| | | |
|---|---|---|
| 3,031,787 | 5/1962 | Womble, Jr. . |
| 3,066,433 | 12/1962 | Rogers . |
| 3,139,694 | 7/1964 | Schaefer . |
| 3,713,239 | 1/1973 | Sperling . |
| 4,198,026 | 4/1980 | Capolupo . |
| 5,048,212 | 9/1991 | Mossberg . |
| 5,050,328 | 9/1991 | Insko . |
| 5,724,760 | 3/1998 | Langer . |

FOREIGN PATENT DOCUMENTS

| | | | |
|---|---|---|---|
| 378767 | 8/1923 | Denmark | 42/70.11 |

*Primary Examiner*—Jack W. Lavinder
*Attorney, Agent, or Firm*—Liniak, Berenato, Longarce & White

[57] ABSTRACT

A trigger safety block for guns including a unitary rigid block made of rigid plastic or a metal block. The trigger safety block has a rigid plate and two projections extending from the rigid plug through the trigger area of the gun. A first projection extends behind the trigger of the gun to prevent depression of the trigger. A second projection extends through the trigger area in front of the trigger and between the trigger and trigger gun. The first and second projections preferably are dimensioned to frictionally fit between the trigger and tiger guard. Each of the projections has an aligned bore extending therethrough and receives a lock member to prevent the trigger block from being removed from the trigger area.

7 Claims, 1 Drawing Sheet

TRIGGER SAFETY BLOCK

BACKGROUND OF THE INVENTION

1. Field of the Invention

The present invention is directed to a security device for storing a firearm and is particularly directed to a handgun trigger block.

2. Description of the Prior Art

Various firearm locking devices have been made available for securing and locking firearms in a safe condition. However, many the prior art devices have not gained general acceptance.

One such trigger safety device is disclosed in U.S. Pat. No. 5,724,760 and is incorporated herein by reference. However, this trigger safety device has only a single projection extending behind the trigger. Such an arrangement is likely to place high stress concentrations on the trigger and block during an attempt to dislodge the trigger block from the trigger area.

U.S. Pat. Nos. 5,048,212, 4,198,026, 3,713,239 each disclose various trigger block devices and are incorporated herein by reference. Each of these references suffer from obvious drawbacks as indicated below.

All of the trigger blocks of the prior art will place undue stress on the trigger assembly and trigger block during an attempt to wrench the trigger block from the trigger area. The present invention employs a second extension to more solidly lock the trigger block in place and alleviate stress concentrations on the trigger assembly and trigger block during an attempt to dislodge the trigger block from the trigger area.

SUMMARY OF THE INVENTION

The present invention is directed to a trigger safety block for guns including a unitary rigid block made of rigid plastic or a metal block. The trigger safety block has a rigid plate and two projections extending from the rigid plug through the trigger area of the gun. A first projection extends behind the trigger of the gun to prevent depression of the trigger. A second projection extends through the trigger guard area in front of the trigger and between the trigger and trigger guard. The first and second projections preferably are dimensioned to frictionally fit between the trigger and trigger guard. Each of the projections has an aligned bore extending therethrough and receives a lock member to prevent the trigger block from being removed from the trigger area.

DETAILED DESCRIPTION OF THE PRESENT INVENTION

Figure 1:
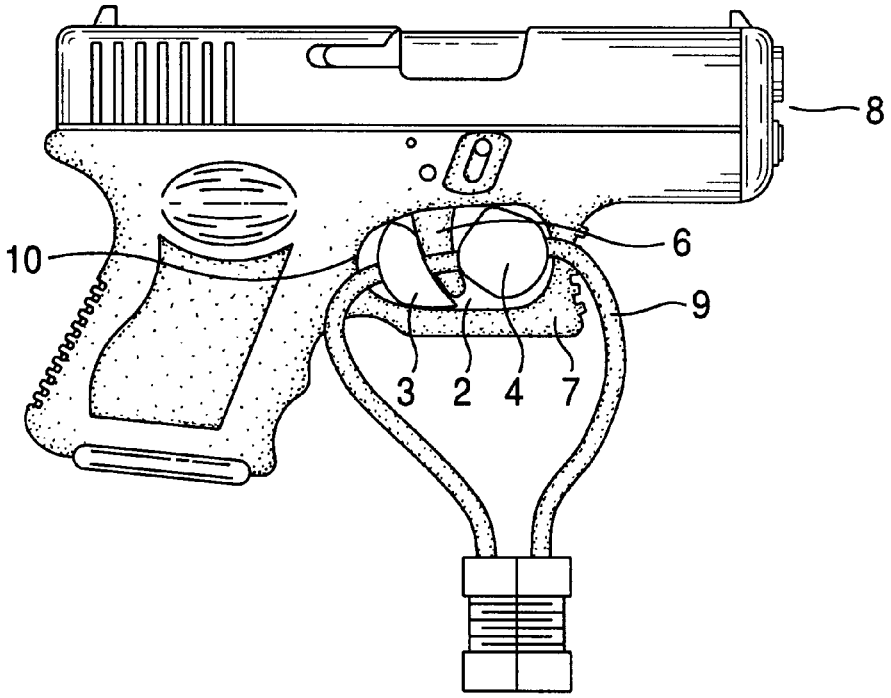
FIG. 1 is a side perspective view of the trigger block according to the instant invention employed in a trigger area of a firearm.
Figure 2:
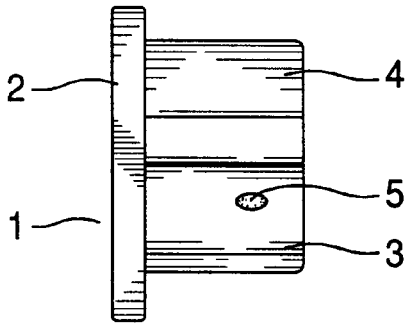
FIG. 2 is a side view of the trigger block according to the present invention.
Figure 3:
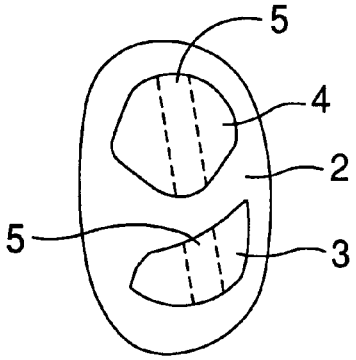
FIG. 3 is a front view of the trigger block of FIG. 2

FIG. 1 represents the trigger block 1 of the present invention employed in a common handgun 8. The trigger block 1 has a side plate 2 having an area larger than an area defined by trigger guard 7 and the adjoining portion 10 of the gun 8. A rear projection 3 extends through the trigger area behind the trigger 6. The presence of the rear projection 3 prevents depression of the trigger 6 and thus preventing firearm discharge. Preferably the rear projection 3 is dimensioned to frictionally fit behind trigger 6. Such an arrangement prevents any movement of the trigger 6.

The trigger block 1 of the present invention has a second front projection 4 extending through the trigger area in front of trigger 6. The front projection 4 is preferably dimensioned to frictionally fit between the trigger 6 and trigger guard 7. It is further noted that customized trigger blocks can be made for specific firearms. In such a case, rear projection 3 and front projection 4 are dimensioned to substantially conform to respective areas between the trigger 6 and trigger guard 7 and the adjoining portion 10 of the gun 8.

Each of the rear projection 3 and front projection 4 have aligned bores 5 extending therethrough. The aligned bores 5 are positioned beyond trigger 6 to receive a lock member 9. When lock member 9 is disposed through the aligned bores 5 of the front 4 and rear 3 projections, removal of the trigger block 1 from the trigger area of the firearm 8 is prevented.

The arrangement of the present invention serves to provide a more snug fit between the trigger block 1 and trigger 6. When the trigger block is locked in place, the configuration of the present invention provides little room for displacement during an attempt to dislodge the trigger block 1. Furthermore, during an attempt to dislodge the trigger block 1, locking member 9 engages trigger guard 7 and the adjoining portion of the gun 10. This benefit substantially, if not entirely, reduces stress induced in the trigger when an attempt to wrench the trigger block 1 from the trigger 6 occurs.

The trigger block 1 is preferable made of a unitary rigid plastic block. However, the trigger block 1 can also be formed of a metal block or additional structurally sound solid materials capable or preventing depression of the trigger 6.

While the foregoing invention has been shown and described with reference to a preferred embodiment, it will be understood by those possessing skill in the art that various changes and modifications may be made without departing from the spirit and scope of the invention.

What is claimed is:

1. A trigger safety lock for guns having a trigger guard circumscribing a trigger area and a trigger disposed within said trigger area, said trigger safety lock comprising:

a rigid plate;

a first projection projecting laterally from a first side of said rigid plate and configured to fit in a rear space between a rear portion of said trigger and said trigger guard to prevent depression of said trigger;

a second projection offset from said first projection projecting laterally from said first side of said rigid plate and configured to fit in a front space between a front portion of said trigger and said trigger guard;

wherein said first and second projections each extend beyond said trigger when inserted within said rear and front spaces respectively, said first and second projections each having a substantially aligned bore extending through a portion of said projection extending beyond said trigger, said substantially aligned bores adapted to receive a lock member extending therethrough to prevent removal of said trigger safety lock from said trigger area, wherein said first projection is dimensioned to substantially occupy said rear space and to substantially conform to a contour of said rear portion of said trigger and a contour of a rear portion of said trigger guard to prevent depression of said trigger.

2. The trigger safety lock according to claim 1 wherein said rigid plate, said first projection and said second projection are homogeneously formed as a unitary body.

3. The trigger safety lock according to claim 2, wherein said unitary body is formed of molded plastic.

4. The trigger lock according to claim 2, wherein said unitary body is formed of metal.

5. The trigger safety block according to claim 1, wherein said first projection is dimensioned to frictionally fit in said rear space.

6. The trigger lock according to claim 5, wherein said second projection is dimensioned to fictionally fit in said front space and to substantially conform to a contour of said front portion of said trigger and a contour of a front portion of said trigger guard.

7. A combination gun, trigger safety block and lock;

said gun comprising:

a main body portion;

a trigger guard attached to said main body portion, said trigger guard and said main body portion together circumscribing a first trigger area;

a trigger disposed within said trigger area, said trigger pivotally connected to said main body portion of said gun and adapted to fire said gun when depressed;

said trigger safety block comprising;

a substantially planar rigid member disposed adjacent to said trigger area, said substantially planar rigid member having an second area larger than said first trigger area to prevent said rigid member from passing through said first trigger area;

a first projection projecting laterally from a first side of said rigid member and extending through said first trigger area beyond said trigger, said first projection being configured to fit in a rear space between a rear portion of said trigger and a rear portion of said trigger guard and main body to prevent depression of said trigger;

a second projection offset from said first projection projecting laterally from said first side of said rigid member and extending through said first trigger area beyond said trigger, said second projection being configured to fit in a front space between a front portion of said trigger and a front portion of said trigger guard;

wherein said first and second projections each have a substantially aligned bore extending through a portion of said projection which extends beyond said trigger; and said lock comprising an elongate member disposed within and extending through said aligned bores beyond said first and second projections to prevent removal of said trigger block and maintain said first and second projections within said rear and front space respectively; and a means for preventing said elongate member from dislodging from said aligned bores.

* * * * *